US005555659A

United States Patent [19]

Hade

[11] Patent Number: 5,555,659

[45] Date of Patent: Sep. 17, 1996

[54] APPARATUS FOR MOUNTING FLEXIBLE BANNERS

[75] Inventor: Conrad Hade, South Salem, N.Y.

[73] Assignee: Dinaco, Inc., Irvington-on-Hudson, N.Y.

[21] Appl. No.: 292,834

[22] Filed: Aug. 19, 1994

[51] Int. Cl.[6] ..... G09F 17/00

[52] U.S. Cl. ..... 40/604; 160/329; 160/378

[58] Field of Search ..... 40/603, 604; 38/102, 38/102.1, 102.8; 160/329, 378

[56] References Cited

U.S. PATENT DOCUMENTS

| | | | |
|---|---|---|---|
| 2,251,415 | 8/1941 | O'Donnell | 160/329 |
| 2,898,989 | 8/1959 | Peterson | 160/329 |
| 4,580,361 | 8/1986 | Hillstrom et al. | 160/378 |

FOREIGN PATENT DOCUMENTS

| | | | |
|---|---|---|---|
| 818417 | 10/1951 | Germany | 160/329 |

*Primary Examiner*—Brian K. Green
*Assistant Examiner*—Cassandra Davis
*Attorney, Agent, or Firm*—Schweitzer Cornman & Gross

[57] ABSTRACT

A banner display comprising a flexible, stretchable banner, a fixed mounting bracket and a hinged mounting bracket. Rigid support tubes are inserted in hems formed at the ends of the banner. The rigid support tubes are attached to mounting rods in the fixed and hinged mounting brackets. The hinged mounting bracket includes a spring mechanism which tensions the banner as the hinged mounting bracket is closed. To mount the banner, the banner is first attached to the fixed mounting bracket. The other end is attached to the hinged mounting bracket which is in the open position. As the hinged mounting bracket is closed, the banner becomes taut. The spring mechanism maintains tension in the banner when the hinged bracket is closed. As the hinged mounting bracket is closed, the mechanical advantage increases allowing the banner to be mounted without additional tools or manpower.

3 Claims, 5 Drawing Sheets

APPARATUS FOR MOUNTING FLEXIBLE BANNERS

BACKGROUND OF THE INVENTION

The present invention relates to the inexpensive, but durable, banner displays for use outdoors and, more particularly for use in fast food restaurants; automotive filling stations; and the like.

The present invention is particularly well-suited for displaying promotional advertising banners for automotive filling stations where it is desired that unskilled employees be able to mount and change the banners with minimal time and effort. Typically, banner displays consist of flexible cloth or plastic banners approximately 3 feet by 12 feet which convey messages of prices and special offers. These displays are mounted on support structures such as a poles or sides of buildings.

Known in the art is U.S. Pat. No. 3,824,724 by Miller et al. which discloses a banner display consisting of a flexible banner supported by rigid tubes at opposite ends of the banner which are inserted through tubular hems formed at the ends of the banner. The center of the hem at each end is removed such that mounting hardware may contact the rigid tubes directly. One rigid tube is placed in the hook of a first mounting bracket which is rigidly attached to a support structure. The other rigid tube is placed in the hook of a second mounting bracket which is attached to the support structure via a spring apparatus. The second mounting bracket moves only parallel to the plane of the banner. To mount the banner, the spring apparatus or the banner, or both, must be stretched. The tension of the spring apparatus pulls the banner taut against the first mounting bracket. The spring force necessary to maintain banner displays of this type can be considerable such that other tools may be required to stretch the spring.

While the prior art device allows banners to be changed without removing all of the mounting hardware, it can be difficult to operate because the step of stretching the banner and/or spring apparatus can require additional tools and/or manpower. The device of the present invention aids in the final step of mounting the banner by employing a spring apparatus which gives the assembler a mechanical advantage in mounting the banner and thus avoids the need for special tools and/or extra manpower.

SUMMARY OF THE PRESENT INVENTION

The new and improved banner display of the present invention consists of several simple but effective elements. The display banner is made of a flexible, stretchable material which is supported on opposite ends by rigid support means, such as tubes, inserted through the hems at the ends of the banner. The rigid tubes are attached to and stretched between a fixed mounting bracket and a hinged mounting bracket. The mounting brackets are attached to a support structure such as a pole, or poles, or the side of a building. The hinged bracket includes a spring toggle mechanism in which a spring is compressed as the bracket is closed, that is, as the bracket is swung toward the support structure. As the spring is compressed, it exerts a force on the banner stretching it and holding it taught. The hinged bracket, when closed, is locked into place by a safety pin.

For a better understanding of the principles and advantages of present invention, reference should be made to the accompanying drawings taken in conjunction with the following detailed description.

DETAILED DESCRIPTION OF THE PRESENT INVENTION

Figure 1:
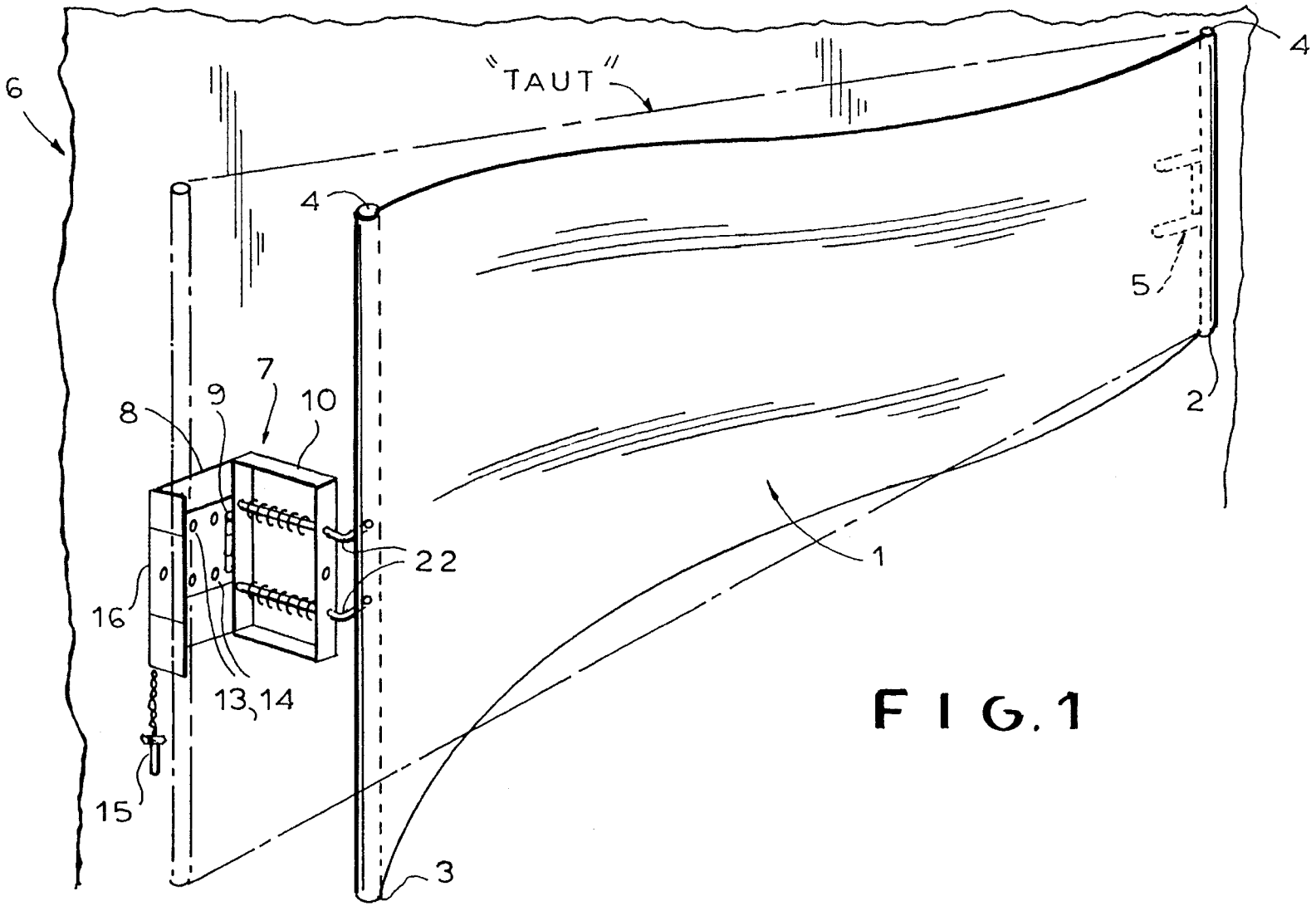
FIG. 1. is a perspective view of a banner assembly, according to the invention, with the hinged bracket in the open position.

Referring to FIG. 1., the banner 1 is made of a flexible, stretchable material such as nylon. First and second rigid tubes 2 and 3 are inserted in the hems 4 of the banner 1 at opposite ends. The first rigid tube 2 is attached to a fixed mounting bracket 5 which is attached to a support structure 6. The second rigid tube 3 is attached to a hinged bracket 7, here shown in the open position.

The hinged bracket 7 includes a base plate 8, a hinge 9, a cover 10, a plurality of hooked mounting rods 11 and a spring assembly 12. The cover 10 is hingedly attached to the base plate 8 by the hinge 9. The hooked mounting rods 11 pass through holes aligned in the rigid tube 3 and banner 1.

The base plate 8 includes a plurality of mounting holes 13, through which mounting screws 14 may be inserted. The base plate 8 also includes a safety pin 15, and a safety pin hole 16 through which the safety pin 15 extends when the hinged bracket 7 is closed.

Figure 2:
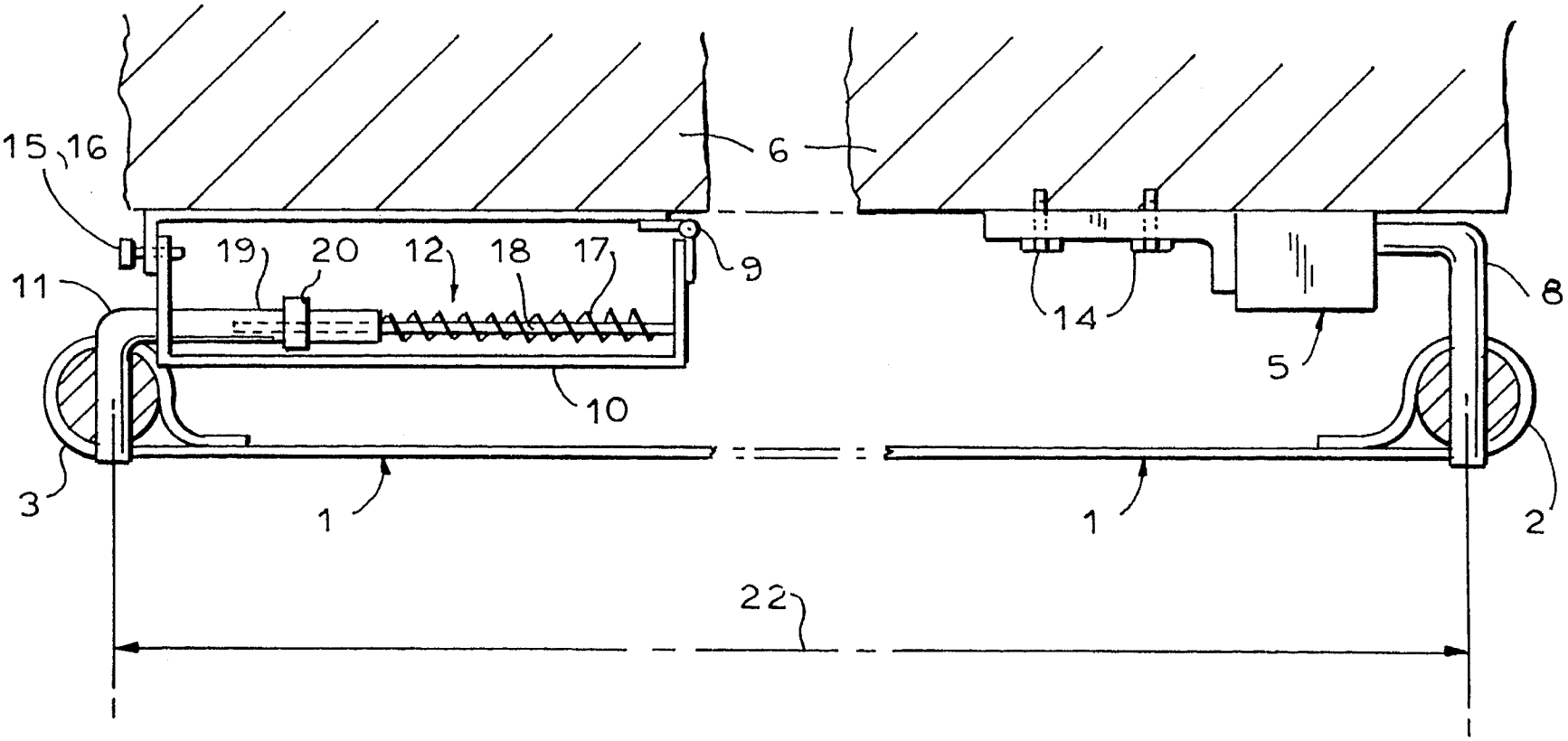
FIG. 2. is a top, cross-sectional view of a banner assembly with the hinged bracket in the closed position.

Referring to FIG. 2., the mounting bracket 5 is fixedly attached to the support structure 6 by mounting screws 14. A plurality of hooked mounting rods 8 are rigidly attached to the fixed mounting bracket 5. The hooked mounting rods 8 pass through holes aligned in the rigid tube 2 and banner 1 in the same manner that the mounting rods 11 in the hinged mounting bracket 7 pass through holes aligned in the rigid tube 3 and banner 1.

The spring assembly 12 includes a plurality of support rods 17 rigidly attached to the cover 10 and a plurality of springs 18 surrounding the support rods 17. The hooked mounting rods 11 are formed with hollow tubular stems 19 which receive the free ends of the support rods 17 and allow the mounting rods 11 to slide over the support rods 17. As the hooked mounting rods 11 slide over the support rods 17, the springs 18 are compressed. Circular collars 20 limit the leftward movement of the mounting rods 11 when the hinged bracket 7 is not under load.

Figure 3:
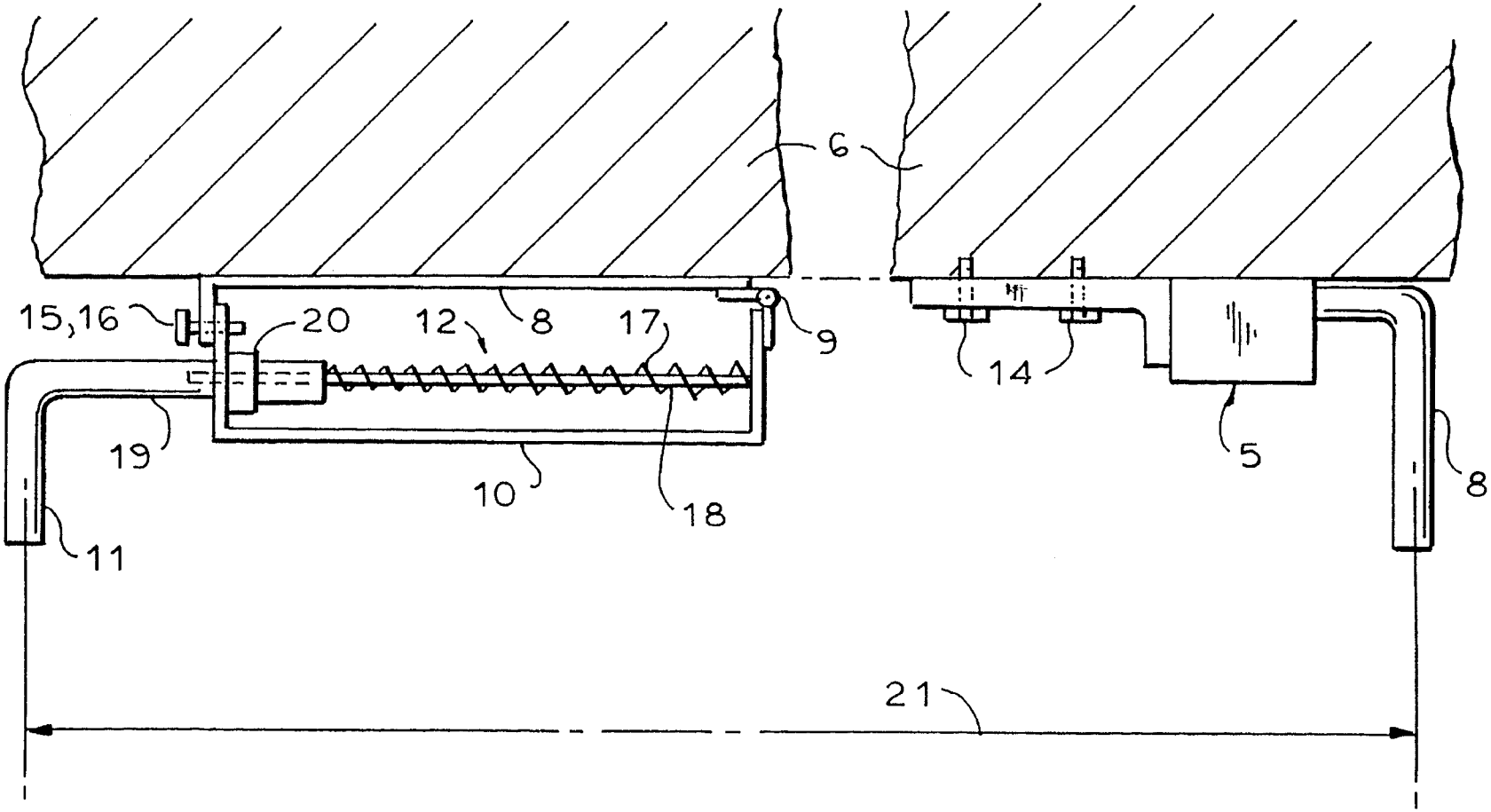
FIG. 3. is a top, cross-sectional view of a hinged bracket in the closed position without load.

FIG. 3. shows the hinged bracket 7 in the closed position without load. Here, the springs 18 are fully extended pushing or biasing the mounting rods 11 to the extreme left. The collars 20 engage the the cover 10 to limit the leftward movement of the mounting rods 11.

It is important to note that the mounting rod distance 21, between the mounting rods 8 attached to the fixed bracket 5 and the mounting rods 11 attached to the hinged bracket 7, is less than the banner length 22, when the hinged bracket 7 is open, as shown in FIG. 1., and greater than the banner length 22 when the hinged bracket 7 is closed and unloaded, a shown in FIG.3.

Figure 4:
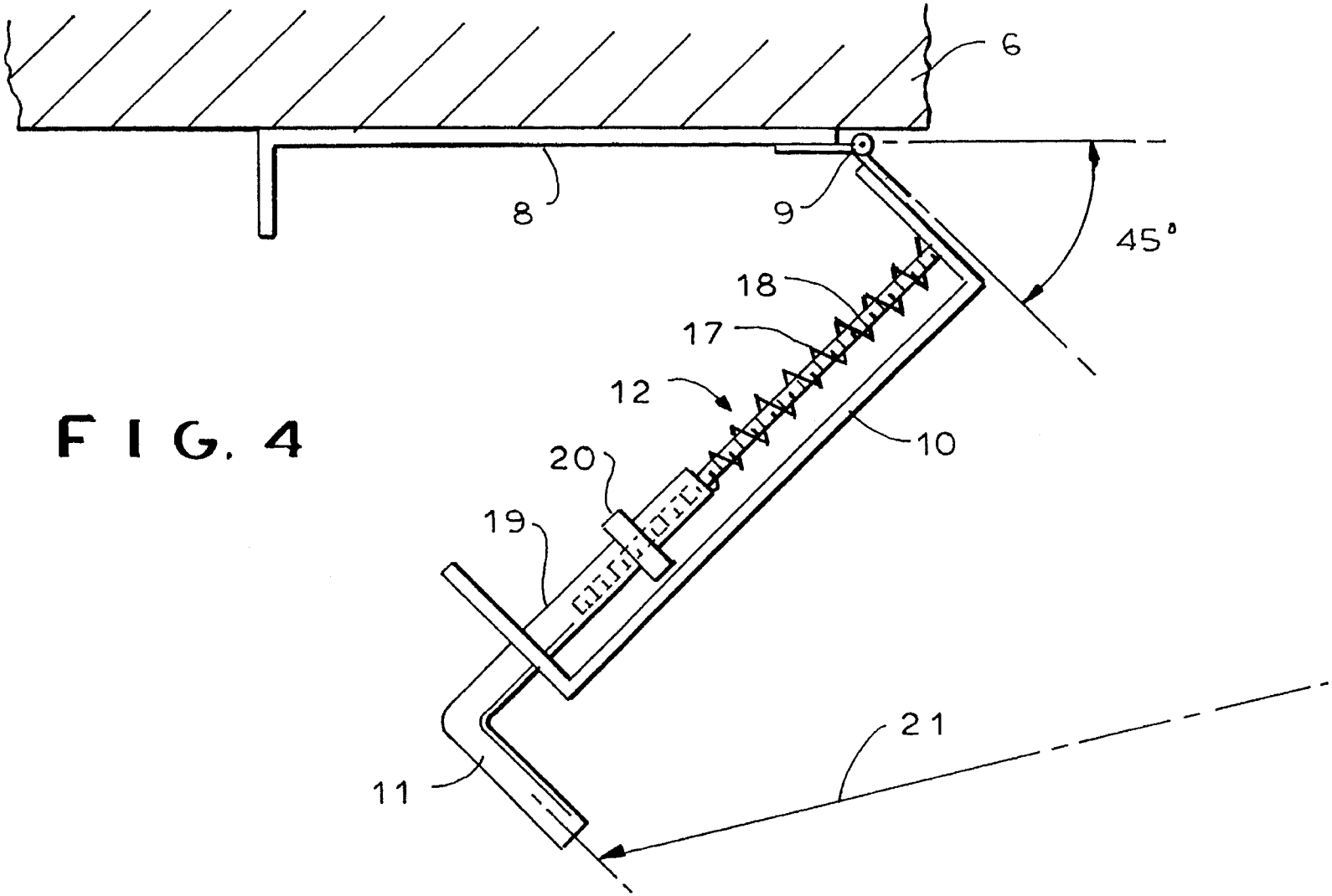
FIG. 4. is a top, cross-sectional view of a hinged bracket at 45 degrees relative to the base plate.
Figure 5:
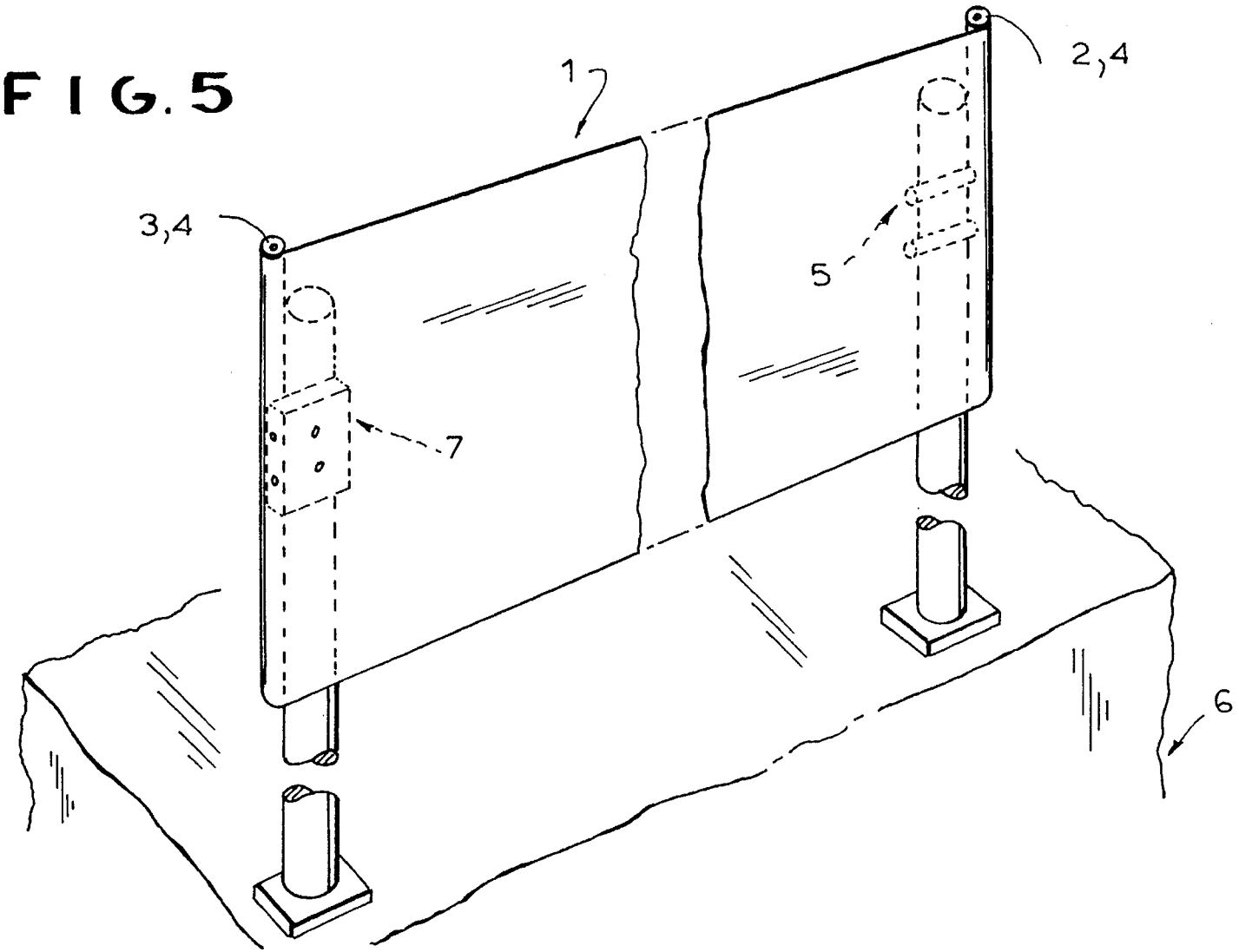
FIG. 5. is a perspective view of the new banner assembly mounted on two support poles.

FIG. 4 shows the hinged bracket 7 at 45 degrees relative to the base plate 8. As the hinged bracket 7 is closed, from 90 degrees to a position parallel to the base plate 8, the mounting rod distance 20 between the mounting rods 8 and 11 increases. At a position between 90 degrees and parallel, the banner 1 becomes taut. Further closure of the hinged bracket 7 is made possible by the mounting rods 11 sliding over the support rods 16. As the mounting rods 11 slide over the support rods 16, the springs 17 are compressed exerting a tensile force on the banner 1. When the hinged bracket is fully closed, as shown in FIG. 2., the springs 17 maintain a tensile force on the banner 1. The safety pin 15 locks the hinged bracket in place, in its fully closed position.

A major benefit of the present invention is that as the hinged bracket 7 is closed, and as tensile force in the banner 1 increases, the mechanical advantage of the hinged bracket 7 increases. This allows the hinged bracket 7 to be closed without extra tools or manpower.

It will be apparent to those skilled in the art form the preceding description, that certain changes may be made in the foregoing sign apparatus without departing form the scope of the invention. Accordingly, it is intended that the descriptive matter hereinabove shall be interpreted as illustrative and in no way limiting, since all equivalents within the scope of this disclosure may be substituted and such substitution is intended to be embraced in the following claims.

I claim:

1. Apparatus for quick mounting large banners, said apparatus comprising (a) a flexible stretchable banner of at least 18 square feet in surface having free ends and a predetermined length area;

(b) a support structure to which a banner may be quickly attached in a predetermined plane;

(c) a first mounting bracket attached to said support structure and having first stationary hooked mounting rods for securing a first of said free ends of said stretchable banner;

(d) a second mounting bracket spaced from said first mounting bracket a distance substantially equal to the length of said flexible stretch banner and having a hinged cover member adapted to swing outwardly of said predetermined plane;

(e) a plurality of second hooked mounting rods carried by said hinged cover, each of said second hooked mounting rods is biased by a spring means for limited movement relative to said hinged cover member; said biasing spring means urging said second hooked mounting rods away from said first mounting bracket;

(f) whereby a second the free of ends of said flexible stretchable banner may be loosely attached to said second hooked mounting rods when said hinged cover member is swung outwardly of said predetermined plane to space said second hooked rods from said first hooked rods a distance less than the length of said banner; and said banner thereafter may be securely displayed when said cover member is return to said predetermined plane to allow said second hooked mounting rods to urge said second hooked rods away from said first hooked rods to make said banner taut in said plane.

2. The apparatus for quick mounting banners of claim 1, in which, (a) said spring biasing means are compression springs disposed over said second hooked mounting rods;

(b) said cover member further includes a plurality of support rods rigidly attached to said hinged cover member over which said second hooked mounting rods may slide as said cover member is pivoted into and out of said predetermined plane.

3. The apparatus of claim 2 wherein (a) said banner has tubular hems formed at its ends with hem holes formed therein;

(b) rigid support means, with holes which align with said hem holes, disposed in said hem; and;

(c) said first and second hooked mounting rods are disposed in said hem holes.

* * * * *